US009095232B2

(12) United States Patent
Myers

(10) Patent No.: US 9,095,232 B2
(45) Date of Patent: Aug. 4, 2015

(54) FITTED RUFFLE

(76) Inventor: Cindy Myers, Austin, TX (US)

( * ) Notice: Subject to any disclaimer, the term of this patent is extended or adjusted under 35 U.S.C. 154(b) by 0 days.

(21) Appl. No.: 11/184,181

(22) Filed: Jul. 19, 2005

(65) Prior Publication Data

US 2007/0017028 A1 Jan. 25, 2007

(51) Int. Cl.
*A47G 9/02* (2006.01)
*A47G 11/00* (2006.01)

(52) U.S. Cl.
CPC ..... *A47G 11/004* (2013.01); *A47G 9/0246* (2013.01); *A47G 9/0284* (2013.01); *A47G 9/0292* (2013.01)

(58) Field of Classification Search
CPC ..... A47G 9/0207; A47G 9/02; A47G 9/0292; A47G 9/0284
USPC ..... 5/482, 493
See application file for complete search history.

(56) References Cited

U.S. PATENT DOCUMENTS 2,763,875 A * 9/1956 Piontkowski ..... 5/493
4,587,683 A * 5/1986 Gardiner ..... 5/493
5,063,626 A * 11/1991 Carlos ..... 5/493
5,086,531 A * 2/1992 Carlos ..... 5/493
5,092,010 A * 3/1992 Wong ..... 5/493
5,479,664 A * 1/1996 Hollander ..... 5/497
5,638,562 A * 6/1997 Masoncup ..... 5/493
5,809,593 A * 9/1998 Edwards ..... 5/497
5,946,750 A * 9/1999 Shiu ..... 5/502
5,966,758 A * 10/1999 Karam ..... 5/493
6,044,503 A * 4/2000 McClendon ..... 5/482
6,886,197 B1 * 5/2005 Madigan ..... 5/482
7,140,053 B1 * 11/2006 Mangano ..... 5/493
2004/0221389 A1 11/2004 McClelland
2005/0086740 A1 * 4/2005 Babjak ..... 5/493
2007/0056099 A1 * 3/2007 Langenberger ..... 5/493

OTHER PUBLICATIONS

Website pages from online catalogs at Costco.com and esleepshop.com showing item description with ReliaGrip spandex bed skirt, published in the USA via the internet.

* cited by examiner

*Primary Examiner* — Gilbert Lee
(74) *Attorney, Agent, or Firm* — The Law Firm of H. Dale Langley, Jr., P.C.

(57) ABSTRACT

A fitted ruffle includes a fitted sheet and a ruffle attached to the fitted sheet. The fitted sheet covers a cushion, box springs or mattress, generally conforms thereto, and maintains the sheet and ruffle in relatively fixed position as so covered.

8 Claims, 6 Drawing Sheets

FITTED RUFFLE

BACKGROUND OF THE INVENTION

The present invention generally relates to bedding and furnishings and, more particularly, relates to a fitted dust ruffle for a bed or the like having a mattress or cushion.

Conventionally, ruffles for service as a bed dust ruffle or for other cushions and furniture have included a cloth sheet that fits between mattress and box springs or otherwise under a similar cushion. The sheet has been sized to substantially conform to a surface of the mattress or cushion, in length and width, such that the sheet is not visible when spread and located under the mattress atop the box springs (or under another cushion where the ruffle is placed under the cushion atop a furniture seat or surface under the cushion, or the like). The sheet has been formed with a peripheral ruffle accessory attached thereto. In use and location in a bed or other furniture, the sheet is substantially hidden and the peripheral ruffle extends beyond the overlying mattress or cushion. In this arrangement, the ruffle hangs down along edges of the bed or cushioned furniture. Of course, the ruffle is typically of a fabric or similar skirt material and is often itself a color(s) or pattern, including, for example, ruffled, ridged, filigreed, border, flat, pleated, ornamental, finery, fluffy, or other decoration to provide an appealing interior design feature and for the bed or other furniture.

When the conventional ruffles are used, the sheet under the mattress or cushion is not fixed with respect to the underlying box springs or surface. This is problematic to maintaining a neat and orderly appearance of the ruffle in its intended position. For example, the conventional bed ruffle tends to shift because of movement of the sheet of the ruffle with respect to the box springs. Sleep and movement of persons on the overlying mattress can displace the ruffle in its desired positioning atop the box springs, such as by shifting laterally, twisting, bunching, and the like. As this shifting of the bed ruffle occurs, the ruffle soon readily becomes out of desired and orderly display.

It would, therefore, be a significant improvement in the art and technology to provide a ruffle that will not significantly shift over time or through use of the ruffle. The present invention provides numerous advantages and improvements, including improvements and nuances in the foregoing respects.

SUMMARY OF THE INVENTION

An embodiment of the invention is a system. The system includes a fitted sheet and a ruffle attached to the fitted sheet.

Another embodiment of the invention is a system for covering and providing an edge ruffle to an object having corners. The system includes top of dimensions for covering the object, a side connected to the top for wrapping the object, a retainer for maintaining the top and the side in relational position with the object, and a ruffle connected to the side.

Yet another embodiment of the invention is system. The system includes a cover, a retainer connected to the cover, and a ruffle connected to the cover.

Another embodiment of the invention is a system. The system includes a fitted cover and a ruffle connected to the fitted cover.

Yet another embodiment of the invention is a method of decorating to supply a ruffle to a furniture. The method includes attaching a ruffle to a fitted sheet and placing the fitted sheet on the furniture, wherein the ruffle locates along edges of a surface of the furniture.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
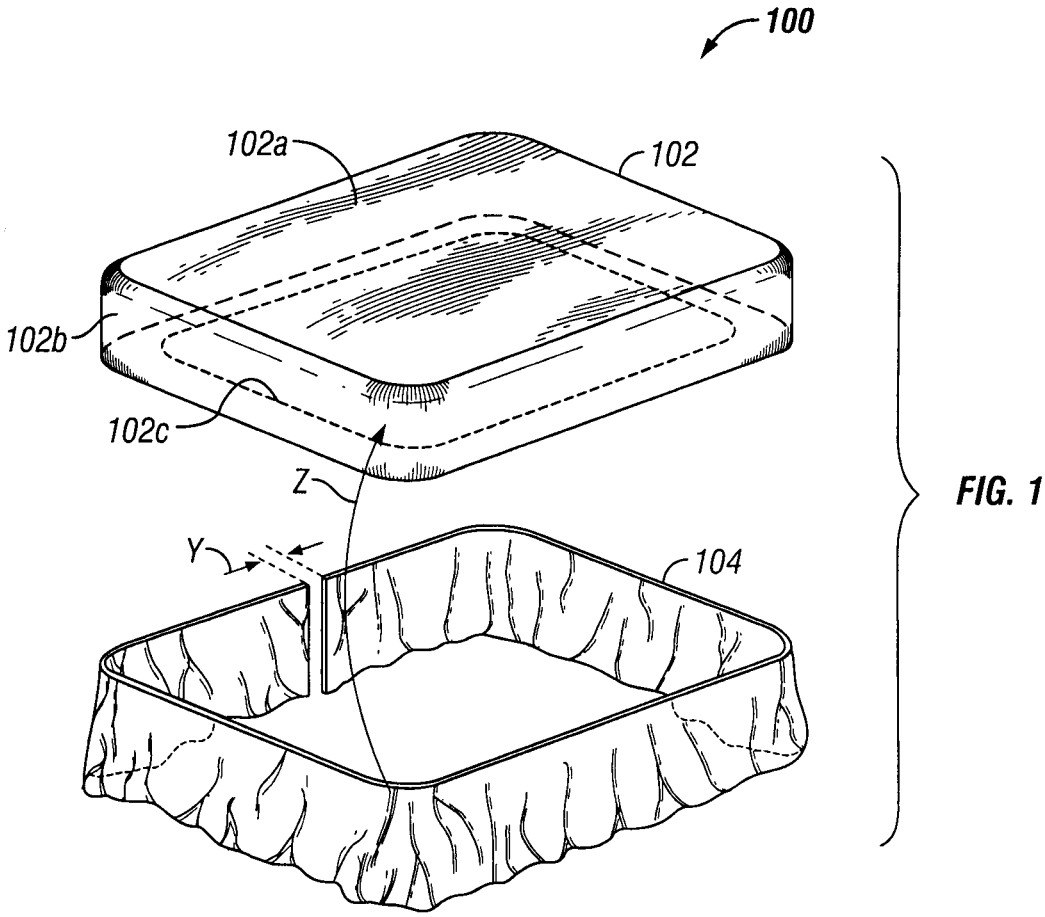
FIG. 1 illustrates a top perspective, exploded view of a fitted bed sheet and ruffle to be joined to the fitted sheet, according to certain embodiments of the invention.

Referring to FIG. 1, a fitted sheet 102 is formed with corners for conforming to a 3-D surface, such as a mattress. The fitted sheet 102 generally has a top 102*a*, sides 102*b*, and an underside rim 102*c* at a periphery of the sheet 102. The fitted sheet 102 can be a bedding sheet that conforms to a mattress via elastic at corner locations of the periphery of the rim 102*c*, elastic around the entire periphery of the rim 102*c*, stretched or tight fit of non-elasticized corner portions, ties at corners, and any of a wide variety of other available or similar fitting mechanisms, as those skilled in the art will understand and appreciate. All such possibilities for fitting of the fitted sheet 102, and its make-up, construction and design, whether or not now known, available or employed, are expressly included in the descriptions herein and no particular fitting mechanism limits the scope of the descriptions.

A ruffle 104 is sized of width as desired for the application, for example, a bed ruffle may be desired to extend downward about 6" to about 15" (or other width, as applicable). The ruffle 104 is sized of length at least as long as the outer periphery form by the top 102*a* of the fitted sheet (and, generally, will be somewhat longer for purposes of joining the ruffle 104 to the sheet 102, as hereinafter further detailed). As further described in subsequent discussion, the ruffle 104 is affixed to the sides 102*b* of the fitted sheet 102, to extend along the extent of the sides 102*b* and to hang from where so affixed. Although the ruffle 104 is shown in FIG. 1 as a continuous length, the ruffle 104 can be multiple portions that are fixed together to form the entire length or can be of different lengths and locations at the sides 102*b* as may be desired for certain applications or uses.

Both the sheet 102 and the ruffle 104 can be cloth of any type, such as cotton, synthetic, or other. The sheet 102 can, for example, be of a typical bed sheet material, such as a 100% cotton or blend. The ruffle 104 can be cloth of any desired materials, including, for example, cotton, silk, tasseled, filigreed, or even of materials other than cloth such as plastics, metals, or the like and as desired for the application and/or ascetic preferences. The ruffle 104 is joined to the sheet 102, for example, along the length of the ruffle 104 at the sides 102*b* of the sheet (illustrated by Arrow Z). The ruffle 104 is joined at its width (if desired or appropriate) at the extent of the ruffle 104 around the sides 102*b* (illustrated by Arrows Y). The terms joined, affixed, attached and the like used herein are intended to refer broadly to all varieties of attachment and fixation schemes, mechanisms and options, including, without limitation, sewing, stitching, snaps, eye-hooks, zipper, Velcro™, glue and any and all other means and combinations.

Figure 2:
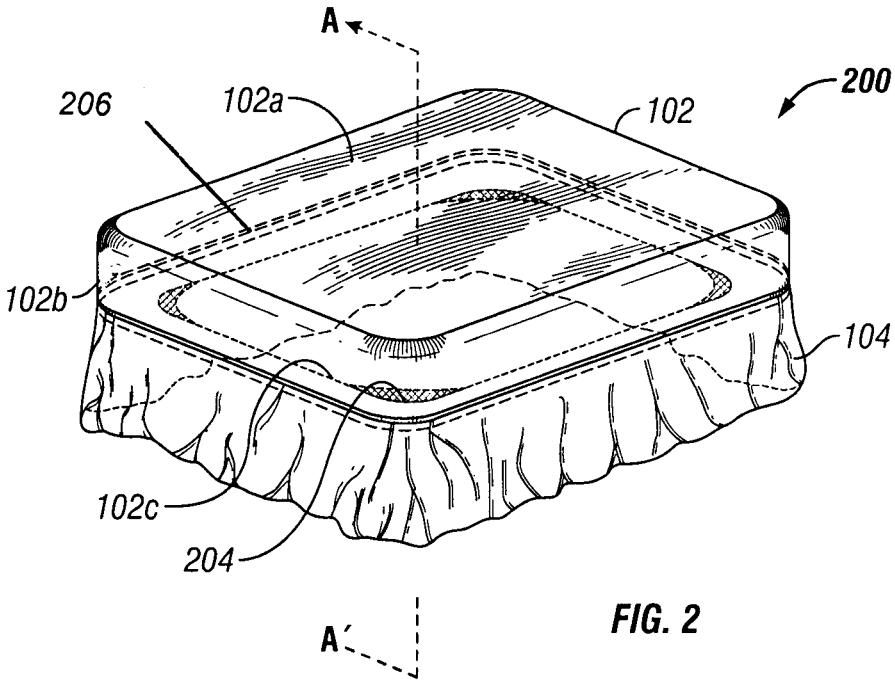
FIG. 2 illustrates a bottom perspective view of the ruffle and fitted sheet of FIG. 1, joined as a fitted ruffle, according to certain embodiments of the invention.

Referring to FIG. 2, a fitted ruffle 200 includes the ruffle 104 of FIG. 1 joined to the fitted sheet 102 of FIG. 1, at a lower edge (in the orientation of FIG. 2) of the sides 102*c* of the sheet 102. The fitted sheet 102, in the example of FIG. 2, includes as a fitting mechanism for the sheet 102, elastic lengths 204 fixed along and at corners of the underside rim 102*c* of the sheet 102. Of course, as previously mentioned, this fitting mechanism can be any of a wide variety of possibilities, alternatively or in addition to the elastic lengths 204; and the elastic lengths 204 are intended as merely an example.

The ruffle 104 is joined to the fitted sheet 102 at a seam 206. This seam 206 affixes an edge of the length of the ruffle 104 to the fitted sheet 102 at a lower edge (in the orientation of FIG. 2) of the sides 102*c* of the sheet 102. The seam 206 extends around the length of the sides 102*c* and the length of the ruffle 104 to join the ruffle 104 and sheet 102. The seam 206 can be any joining, affixing, attaching or other similar mode or combination. For example, the seam 206 can be one or more thread stitches. In certain embodiments, for example, a seamstress can sew, via threads and one or more series of stitching, different types of stitching, and combinations of types of stitching, the ruffle 104 to the sheet 102 at the seam 206. A series combination of three stitches to join the ruffle 104 to the sheet 102 at the seam is effective for certain applications, for example, in a fitted bed ruffle.

The fitted ruffle 200 of FIG. 2 can be employed for covering and maintaining position on a mattress, cushion or the like. A rectangular configuration for the fitted ruffle 200 is desirable, for example, for use of the fitted ruffle 200 with a mattress and box springs (not shown). Of course, numerous shapes and configurations other than rectangular can also be desired and the concepts of the fitted ruffle 200 apply to all such possibilities and should be understood as included in the embodiments and descriptions herein.

Figure 3:
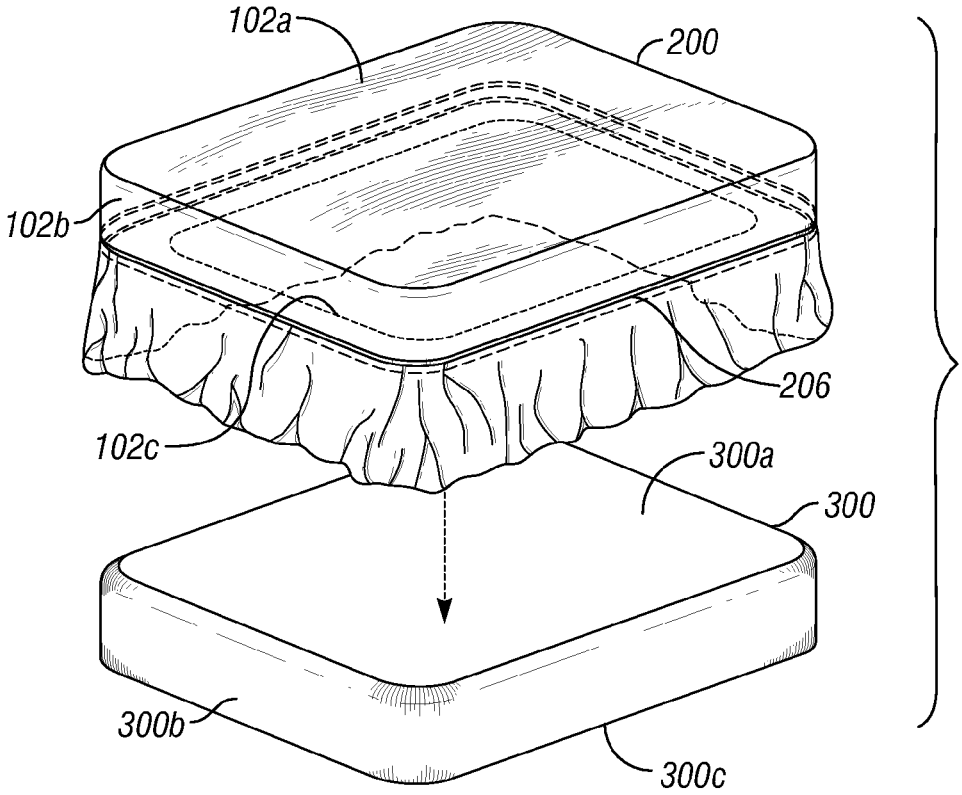
FIG. 3 illustrates a top perspective view of use of the fitted ruffle of FIG. 2, as employable with a mattress or springs of a bed or other cushion, according to certain embodiments of the invention.

Referring to FIG. 3, the fitted ruffle 200 of FIG. 2 is employed with an object 300, such as a rectangular cushion, for example, a mattress, box springs or the like. In operation, the fitted ruffle 200 is located over the object 300 such that the top 102*a* of the sheet 102 locates at a top 300*a* of the object 300. Sides 102*b* of the sheet 102 of the ruffle 200 are positioned around sides 300*b* (or periphery) of the object 300. The underside rim 102*c* of the sheet 102 of the fitted ruffle 200 is positioned peripherally along the underside 300*c* of the object 300. In this manner, the fitted sheet 200 of the fitted ruffle conforms and maintains location on the object 300. The ruffle 104 of the fitted ruffle 200, extends at the seam 206 from the sides 102*b* of the sheet 102 (and these sides 102*b* cover the object sides 300*b*). The ruffle 104 is left to freely hang from the attachment at the seam 206, such that the width of the ruffle 104 is left visible if the object 300 is covered at its top 300*a* or sits atop something adjacent the underside 300*c*. In a mattress and bed springs arrangement, for example, the fitted ruffle 200 can be placed on the bed springs, such that the sheet 102 of the fitted ruffle 200 conforms and is retained in place with the bed springs. Any mattress placed on top of the bed springs, then, covers the top 102*a* of the sheet 102 covering the object 300, but the ruffle 104 remains extended and uncovered so as to hang down as is typical of a ruffle (for example, to cover underlying bed frame, spaces, and the like). Alternatively, the fitted ruffle 200 can be placed on a mattress atop bed springs or otherwise, and, in any event, the ruffle 104 can freely hang along the sides (for example, to cover sides of underlying bed springs and under any bed frame or the like).

Figure 4:
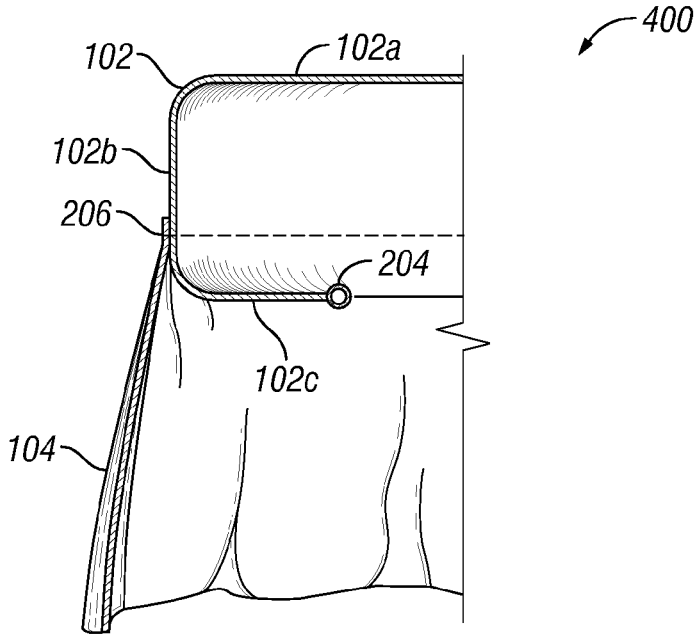
FIG. 4 illustrates a side cross-section view, taken along lines A-A' of FIG. 2 at a corner of the fitted ruffle of that Figure, according to certain embodiments of the invention.

Referring to FIG. 4, a cross-section of a corner area 400 of the fitted ruffle 200 includes the ruffle 104 joined to the fitted sheet 102. The fitted sheet 102 includes the top 102*a*, the sides 102*b*, and the underside rim 102*c* portions. An edge of the underside rim 102*c* includes the elastic length 204 or other means for fitting the sheet 102 (as applicable). The fitted sheet is shown as though fitted in place on an object (object not shown in Figure). The ruffle 104 is joined to the fitted sheet 102 at the seam 206. The lengthwise edge of the ruffle 104 is fixed at the seam 206, and the width portion of the ruffle 104 extends from the seam 206 (for example, as if hanging freely from affixation at the seam 206). The seam 206 is formed as stitching of the ruffle 104 to the sides 102*b* (shown in Figure) or in other joining or affixing manner, as broadly described. In the embodiment of FIG. 4, the seam 206 is located at a lower edge of the sides 102*b* of the sheet 102 and the lengthwise edge of the ruffle 104; however, the seam 206 can, if desired or appropriate for the application, be located at another location of the sides 102*b* or another location of the ruffle 104. In any such instance, the choice of location for and type of seam 206 is variable and subject to wide possibility, alternatives, and discretion, although it is significant that the seam 206 permits the ruffle 104 to extend from joining with the sheet 102. (For example, many alternatives are possible for location of the seam, including: seam can be located at upper or mid point of sides 102*b*, seam can be located on underside rim 102*c* (although at least strip portions of the ruffle may then be located between the covered object and any underlying surface), seam can be located on top 102*a* (although at least strip portions of the ruffle will be atop covered object and/or between top of covered object and surface abutting top of object), and otherwise or combinations.)

Figure 5:
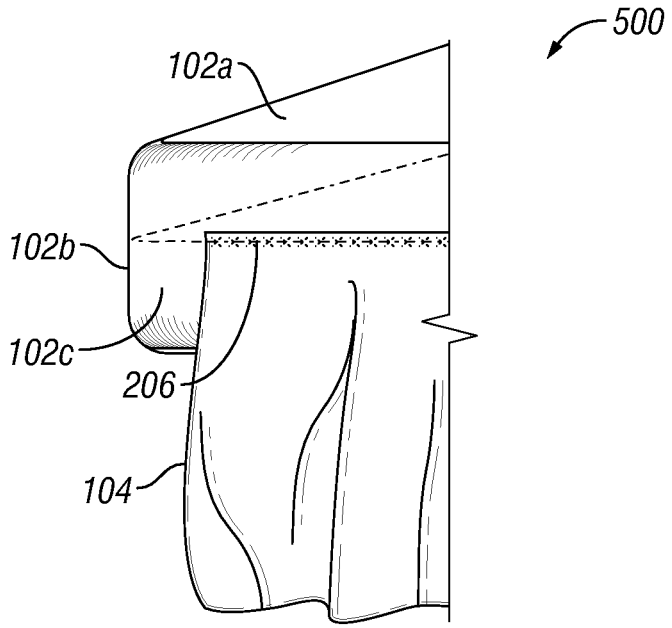
FIG. 5 illustrates a side, partial perspective view, of a ruffle being joined to a fitted sheet during construction of the fitted ruffle of FIG. 2, according to certain embodiments of the invention.

Referring to FIG. 5, manufacture/construction 500 of the fitted ruffle 200 can be better understood in the illustration of partial joining of the ruffle 104 to the sheet 102. In the construction 500, the ruffle 104 is sewn or otherwise affixed at the seam 206 to the side 102*b* of the fitted sheet 102. The joining is partially completed in FIG. 5, as portions of the sides 102*b* have not yet been joined to the ruffle 104. In completing the construction 500, the ruffle 104 is continued to be joined via the seam 206 to the sides 102*c* until all sides 102*c* desired to be so joined are fully joined. As previously mentioned, the ruffle 104 can extend any desired length in its joining to the sheet 102. For example, three of the sides 102*c*, rather than all sides 102*c*, could be fixed with the ruffle 104, or otherwise.

Figure 6:
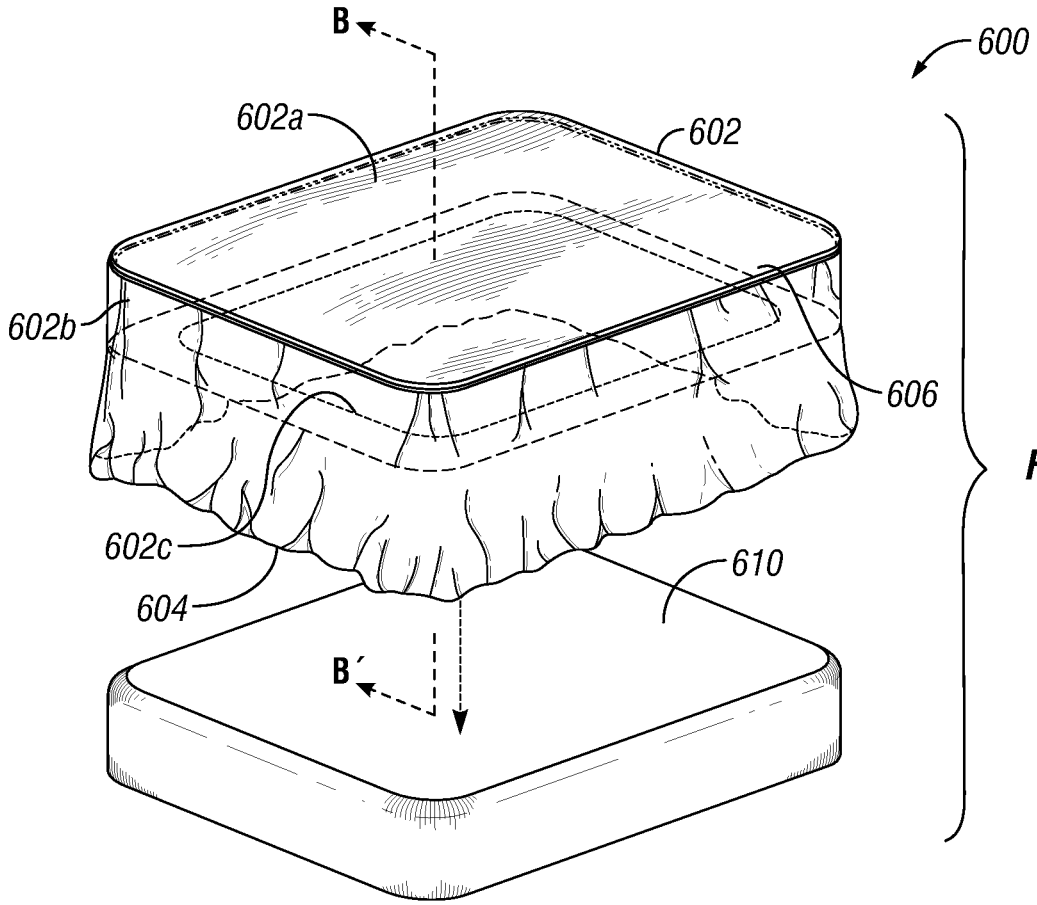
FIG. 6 illustrates a top perspective, exploded view of an alternative fitted ruffle, including a fitted sheet and a ruffle, wherein the ruffle is joined along an upper portion of a side of the fitted sheet (in comparison to FIG. 2), and as employable with a mattress or springs of a bed or other cushion, according to certain embodiments of the invention.

Referring to FIG. 6, an alternative fitted ruffle 600 includes a seam 606 located at an upper edge of sides 602*b* of a fitted sheet 602. The fitted sheet 602 includes a top 602*a*, sides 602*b*, and a rim 602*c*. The ruffle 604 is joined to the upper edge of sides 602*b* at the seam 606, thereby permitting the ruffle 604 to hang in a manner to outwardly conceal the sides 602*b* of the sheet 602. The fitted ruffle 600 is placed over an object 610, such as a mattress, box springs or other cushion or object.

Figure 7:
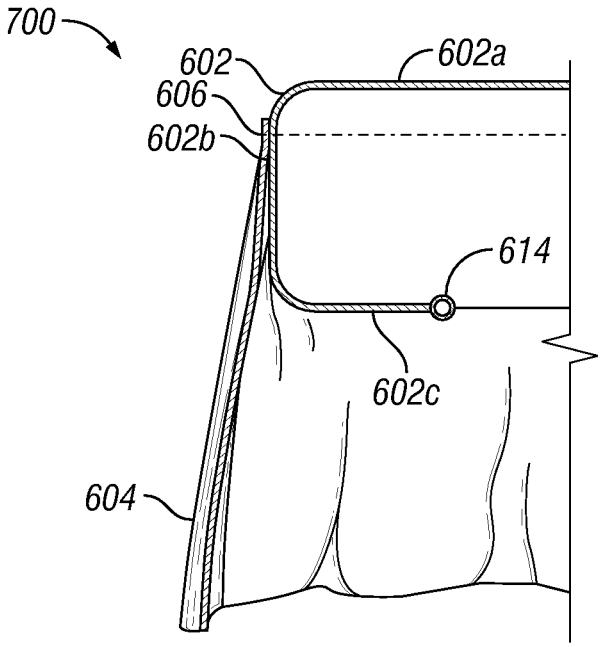
FIG. 7 illustrates a side cross-section view, taken along lines B-B' of FIG. 6 at a corner of the fitted ruffle of that Figure, according to certain embodiments of the invention.

Referring to FIG. 7, a cross-section of a corner area 700 of the fitted ruffle 600 includes the ruffle 604 joined to the fitted sheet 602 at an upper portion of the sides 620*b*. The fitted sheet 602 includes the top 602*a*, the sides 602*b*, and the rim 602*c* portions. An edge of the underside rim 602*c* includes an elastic strip 614 or other means for fitting the sheet 602 (as applicable). The ruffle 604 is joined to the fitted sheet 602 at the seam 606. The lengthwise edge of the ruffle 604 is fixed at the seam 606, and the width portion of the ruffle 104 extends from the seam 606. In the embodiment of FIG. 7, the seam 606 is located at an upper portion of the sides 602*b* of the sheet 602 and the lengthwise edge of the ruffle 104.

Figure 8:
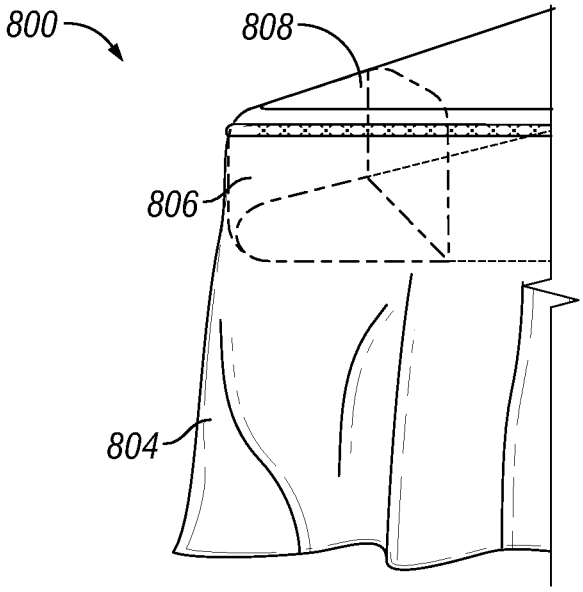
FIG. 8 illustrates a side, partial perspective view, of another alternative fitted ruffle, wherein the ruffle is formed with corner pockets (in lieu of an entire fitted sheet), for use to position the corners of the ruffle at a generally angled corner edge of a mattress, cushion or the like, according to certain embodiments of the invention.

Referring to FIG. 8, another alternative fitted ruffle 800 does not include any fitted sheet. Rather the ruffle 804 is formed with corner pockets 808 along an upper edge of the ruffle 804. The pockets 808 conform to the shape of a corner 806 or other portion of an object with which the fitted ruffle 800 is used. The pockets 808 can be sewn or otherwise attached to or with the ruffle 804 at the corner 806 location along the ruffle 804 length. The ruffle 804, itself, can be of an elastic material or can incorporate an elastic material in an upper edge of the ruffle 804. However, if the ruffle 804 and corners 806 are selectively located and proportioned to conform to the object to be covered, such elasticity may not be required. The fitted ruffle 800 is maintained in place on the object by locating the object corners in the pockets 806.

Figure 9:
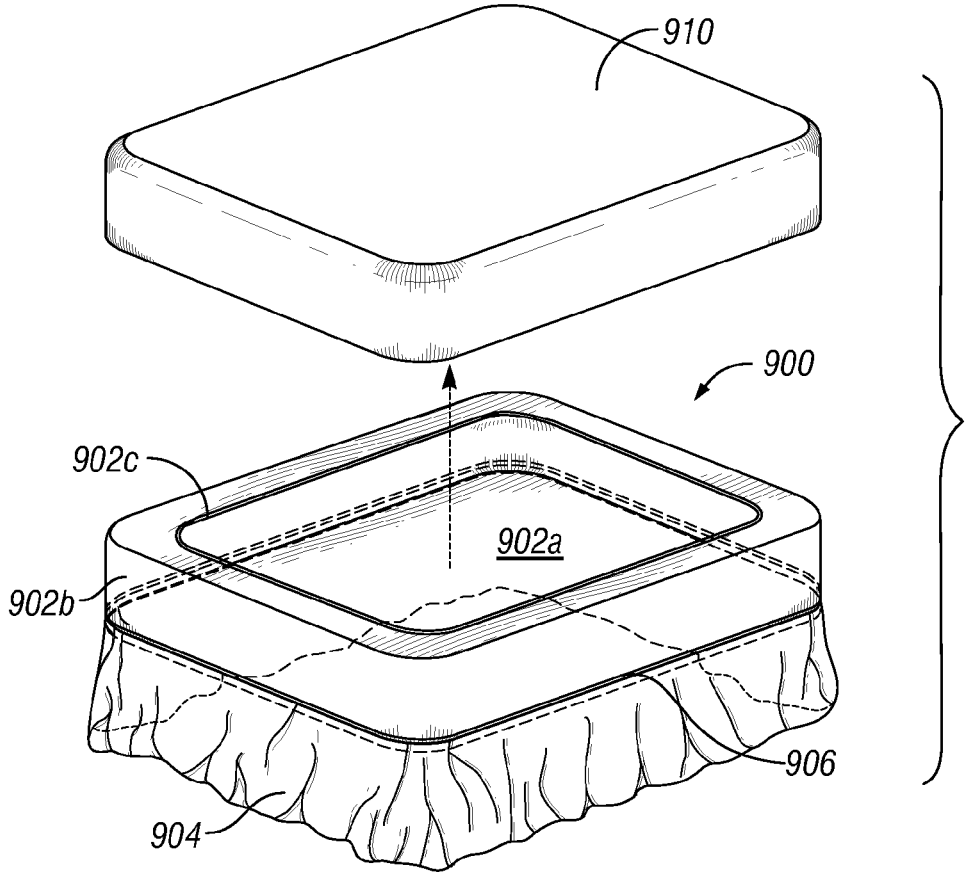
FIG. 9 illustrates a bottom, perspective view, of another alternative fitted ruffle, including a ruffle joined to a fitted sheet, but employable to fit the fitted sheet to an underside of a mattress, cushion or the like, according to certain embodiments of the invention.

Referring to FIG. 9, another alternative fitted ruffle 900 includes a ruffle 904 joined at a seam 906 to a fitted sheet 902. The fitted sheet 902 has a top bottom 902*a*, sides 902*b*, and an upper rim 902*c*. In the fitted ruffle 900, the fitted sheet 902 is basically an upside down fitted sheet (as employed in the previous descriptions). The fitted sheet covers an object 910, such as a mattress, box springs, cushion or other, at an underside of the object 910. The bottom 902*a* of the sheet 902 covers the underside of the object 910. The sides 902*b* wrap sides of the object 910, and the upper rim 902*c* fits along an upper side of the object 910. The ruffle 904 is fixed to the fitted sheet 902 at the seam 906 at a location along the sides 902*b*.

Figure 10:
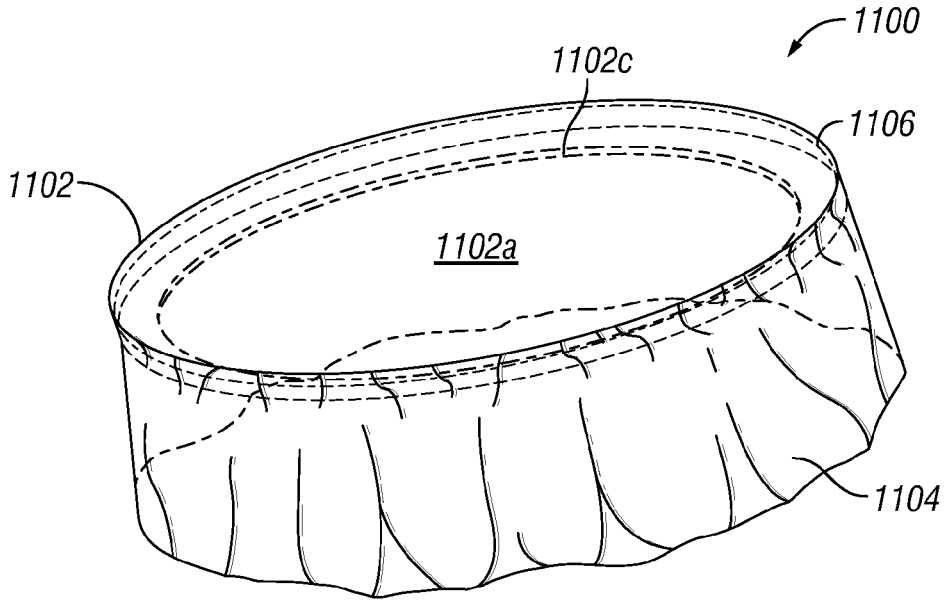
FIG. 10 illustrates an alternative fitted ruffle, having a generally oval shape for fitting an oval cushion or surface, and including at a periphery of a sheet of the fitted ruffle an elastic or other retainer, according to certain embodiments of the invention.

Referring to FIG. 10, a fitted ruffle cover 1100 includes an upper sheet portion 1102*a* and an under rim portion 1102*c*. The upper sheet portion 1102*a* is sized to cover a top or upper side of an object (not shown). The rim portion 1102*c* is connected to the upper sheet portion 1102*a* at a seam 1106. The upper sheet portion 1102*a* and the rim portion 1102*c* can be separate and joined pieces, or they can, depending on the materials and construction, be formed as a unitary piece. At the seam 1106, a ruffle 1104 is attached to the upper sheet portion 1102*a* and the rim portion 1102*c* where they join. The rim portion 1102*c* can include along the peripheral edge thereof an elastic or other clinching feature.

In operation, the fitted ruffle cover 1100 is place atop an object with the upper sheet portion 1102*a* cover the top of the object. The rim portion 1102*c* is tucked around and under the top of the object. The ruffle 1104 hangs from the seam 1106. The fitted ruffle cover 1100 can be employed in a wide variety of applications, including, for example, coffee table cover, bar stool cover, chair seat cover, or other use where a ruffle is desired.

Figure 11:
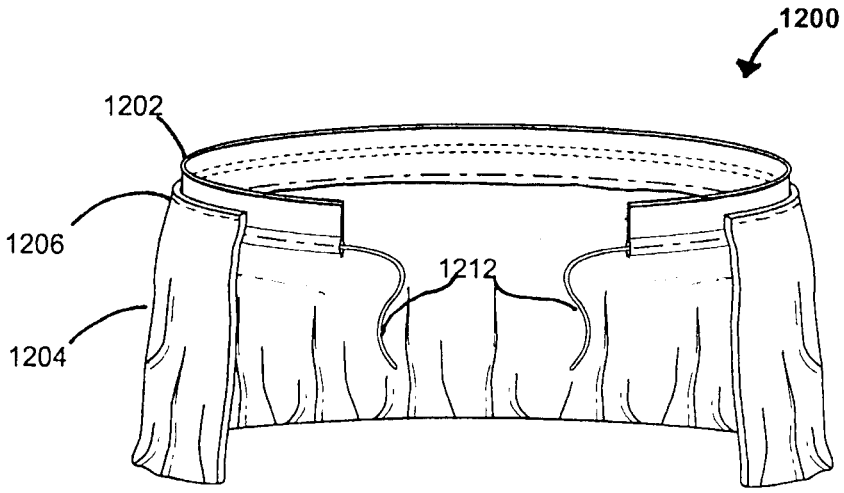
FIG. 11 illustrates an alternative retainer for a fitted ruffle, wherein the retainer includes a cord enveloped in a periphery side strip to which is joined a ruffle, according to certain embodiments of the invention.

Referring to FIG. 11, another fitted ruffle 1200 does not include an upper sheet portion, but instead includes a fitted sides strip 1202. The fitted sides strip 1202 may itself be elastic or include elastic elements. Alternatively, the strip 1202 can include another fixing mechanism for retaining the strip 1202 with an object, such as a table, mattress, cushion, box springs, or other. An example fixing mechanism includes a cord 1212 embedded or attached to the strip 1202. The cord 1212 can be pulled and tied to secure the strip 1202 as desired. A ruffle 1204 is joined to the strip 1212.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and any element(s) that may cause any benefit, advantage, or solution to occur or become more pronounced are not to be construed as a critical, required, or essential feature or element of any or all the claims. As used herein, the terms "comprises, "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system for adorning a box springs, the box springs, in use under a mattress, forming a generally horizontally disposed generally planar top surface having circumscribing peripheral edges and a thickness extending from the peripheral edges, comprising:

a sheet having a circumscribing border sized to cover the top surface of the box springs and wrap the thickness at the peripheral edges, with the border of the sheet extending at least slightly under, and along an entirety of the peripheral edges of, the box springs when horizontally disposed in use;

an elastic band attached to the sheet along an entirety of the border, the elastic band stretchable to position the sheet covering the top surface wrapping the thickness of the box springs, with the border and the elastic band in combination located under, and along an entirety of the peripheral edges of, the box springs when horizontally disposed in use, and compressible to retain the sheet tautly positioned covering the top surface and wrapping the thickness of the box springs;

a ruffle having length extending along at least three sides of the box springs when the sheet is retained in position covering the top surface and draping the lower portion of the thickness of the box springs when horizontally disposed in use; and stitches extending along the length of the ruffle, the stitches directly fixing the ruffle to the a lower portion of the sheet where the sheet wraps the thickness of the box springs, and outwardly disposed opposing the box springs when the sheet covers the top surface and wraps the thickness at the peripheral edges of the box springs;

whereby the ruffle, exclusively by the sheet, the stitches and the elastic band in combination, is positionally retained outwardly disposed at the thickness, with the ruffle draping the lower portion of the thickness of the box springs behind the ruffle when the box springs is horizontally disposed in use;

whereby, when the sheet covers the top surface and wraps the thickness at the peripheral edges of the box springs, exclusively the sheet, the stitches and the elastic band, in combination, retain the ruffle positioned outwardly disposed at the thickness of the box springs draping the lower portion of the thickness, preventing migration of the ruffle when the mattress is located and shifted in use atop the box springs.

2. A system for adorning a vertically raised generally horizontally disposed box springs in use with an overlaid mattress, the box springs being defined by a top surface having circumscribing peripheral edges and a thickness extending from the peripheral circumscribing edges of the top surface, consisting essentially of:

a sheet having a sheet top of dimensions suitable to cover the top surface of the box springs, between the box springs and the mattress, form sheet sides for generally conforming to the circumscribing edges of the top surface of the box springs, and continue to sheet edges extending across the thickness of the box springs to beneath the box springs entirely along the thickness at the circumscribing edges of the box springs;

a bottom draw portion attached to the sheet edges, and extending along an entirety of the sheet edges, the bottom draw portion expandable to allow the sheet to be placed covering the top surface of the box springs, the sheet edges to conform to the circumscribing edges and extend across the thickness of the box springs, and the sheet edges and the bottom draw portion to locate under the box springs in use;

a ruffle extending across the thickness of the box springs, outwardly oriented on the sheet edges at the thickness of the box springs draping the lower portion of the thickness when the sheet covers the top surface, the ruffle conforms to the circumscribing edges and has length extending along at least three of the circumscribing edges, and the bottom draw portion and the sheet edges extend under the box springs in use; and stitches extending along entirety of length of the ruffle, directly fixedly securing the ruffle to the lower sheet edges where the sheet wraps the thickness of the box springs, and outwardly disposed opposing the box springs when the sheet covers the top surface and conforms to the circumscribing edges of the box springs;

whereby, in use on the box springs overlain by the mattress, the ruffle generally vertically downwardly freely drapes from attachment via the stitches to the sheet at the sheet sides, outwardly covering the lower portion of the thickness of the box springs and below the box springs;

whereby exclusively the sheet, the stitches and the bottom draw portion, in combination, positionally retain the ruffle outwardly oriented on the sheet at the thickness of the box springs draping the lower portion of the thickness, notwithstanding shifting of the mattress overlain atop the box springs in use.

3. The system of claim 2, wherein the bottom draw portion is formed at the sheet edges of the sheet with an elastic draw for retaining the sheet taughtly covering the top surface, the circumscribing edges, and the thickness of the box springs, and extending beneath the box springs, and the ruffle positioned at the thickness of the box springs exclusively by the elastic draw in combination with the sheet and the stitches.

4. The system of claim 2, further consisting essentially of an elastically operative edge of the sheet connected to and extending along an entirety of the sheet sides and locatable under the box springs when the sheet is employed on the top surface and extends across the thickness to the sheet edges beneath the box springs, wherein exclusively the elastically operative edge, the sheet, and the stitches, in combination, snugly retain the sheet covering the box springs and the ruffle along the thickness of the box springs draping the lower portion of the thickness.

5. The system of claim 4, wherein the sides of the sheet wrappingly extend to locate underneath the box springs, with the elastically operative edge being positionable solely beneath the box springs with the sheet top covering the top surface of the box springs and the sheet edges covering the sides of the box springs, thereby retaining the sheet top with the top surface of the box springs in tension, together with the ruffle positioned hanging from attachment directly to the sheet edges of the sheet thereby concealing underneath the box springs.

6. A system for adorning a box springs of a bed set including a box springs and a mattress, the box springs includes a top surface, springs sides forming a thickness of the box springs, and a bottom surface, comprising:

a cover forming a top, sides distinguishably extending from the top, and a bottom portion, suitable in use for covering the top surface by the top, the springs sides by the sides, and a portion of the bottom surface by the bottom portion, the top of the cover concealing the top surface, the sides of the cover concealing the springs sides, and the bottom portion of the cover at least partially conceals the bottom surface in use;

an elastic retainer connected to the bottom portion of the cover, the retainer, in combination with the cover, the sides, and the bottom portion, exclusively retain the cover in taught relation to the top surface, the springs sides, and at least part of the bottom surface, wrappingly concealing within the cover the top surface, the springs sides, and the at least part of the bottom surface in use;

a ruffle having length extending along at least three of the springs sides, draping the lower portion of the springs sides; and sewn stitches directly permanently fixing the ruffle to the lower sheet edges between the top and bottom portion, the sewn stitches exclusively retaining the ruffle to the cover, and the ruffle retained to the box springs exclusively by the cover and the elastic retainer, and the ruffle drapes the lower portions of the sides and below the box springs in use, avoiding migration of the ruffle when the mattress, positioned atop the box springs, is moved.

7. A system for draping below a box springs of a bed set including a mattress, the box springs having a generally planar top defined by top edges of the planar top, a generally planar bottom defined by bottom edges of the planar bottom, and springs sides perpendicularly extending between the planar top along the top edges and the planar bottom along the bottom edges, comprising:

a fitted cover forming a bottom, sides distinguishably extending from the bottom, and a top portion forming peripheral edges of the fitted cover, suitable in use to conform to the planar bottom by the bottom, the springs sides by the sides, and a portion of the planar top by the top portion, the bottom of the fitted cover concealing the planar bottom, the sides of the fitted cover concealing the springs sides, and the top portion of the cover at least partially conceals the planar top;

a peripheral elastic band connected to the fitted cover along the peripheral edges of the top portion, the peripheral elastic band in combination with the fitted cover, exclusively, maintaining a tension to draw the fitted cover at the bottom to the planar bottom and at the sides to the spring sides of the box springs;

a ruffle having length continuously extending along at least three of the sides draping the lower portion of the sides; and stitches fixedly attaching the ruffle directly to the fitted cover at a lower portion between the bottom and the sides, whereby the ruffle freely extends from the stitches draping the lower portion of the sides to conceal below the box springs, the stitches maintaining the ruffle to the fitted cover and the ruffle being maintained in positional relation and outwardly oriented along the bottom edges of the box springs during shifting of the mattress atop the box springs, exclusively by the fitted cover, the stitches and the peripheral elastic band, in combination.

8. A method of decorating to supply an adornment to a bed set of a box springs and a mattress, the mattress being laid atop the box springs in use as the bed set, and the mattress subject to positionally shifting atop the box springs in use, the box springs having a generally planar top surface being generally horizontally disposed in use, a bottom surface parallel to the top surface, and sides defining and connecting the top surface and the bottom surface, comprising the steps of:

providing a sheet sized to cover the top surface of the box springs, wrap the sides of the box springs and extend to peripheral edges of the sheet locatable under the box springs along an entirety of the sides;

attaching an elastic band along an entirety of the peripheral edges of the sheet;

stitching a ruffle to the sheet, the ruffle having length of at least three of the sides of the box springs, to permanently connect the ruffle to the lower portion of the sheet directly where the sheet wraps the sides of the box springs, the ruffle draping the lower portion of the sides, with the peripheral edges located under the box springs along the bottom surface of the box springs, when the sheet covers the top surface and wraps the sides;

stretching the elastic band to accommodate the box springs through the elastic band;

covering the top surface and the sides of the box springs with the sheet after the step of stretching;

locating the elastic band and the peripheral edges of the sheet along the bottom surface of the box springs after the steps of stretching and covering;

whereby the steps of stretching, covering and locating position the ruffle outwardly disposed along at least three of the sides of the box springs, and the ruffle drapes the lower portion of the box springs behind the ruffle;

laying the mattress atop the box springs; and retaining the ruffle from the step of stitching, positioned at the sides of the box springs exclusively by the sheet, the stitches and the elastic band, in combination, upon the steps of stretching, covering, locating and laying, notwithstanding migration and displacement of the mattress in use atop the box springs whereby the ruffle positioned at the at least three of the sides of the box springs freely hangs from attachment to the sheet to drape the lower portion of the box springs to conceal behind the ruffle.

* * * * *